United States Patent [19]

Amador et al.

[11] Patent Number: 4,634,116

[45] Date of Patent: Jan. 6, 1987

[54] SPEED AND STRIKING BAG FREQUENCY DEVICE

[76] Inventors: Raymond A. Amador, 5523 Somerset Dr., Santa Barbara, Calif. 93111; Robert S. Amador, 28025 San Nicolas Dr., Rancho Palos Verdes, Calif. 90274

[21] Appl. No.: 604,232

[22] Filed: Apr. 26, 1984

[51] Int. Cl.[4] ..... A63B 69/00

[52] U.S. Cl. ..... 272/77; 272/DIG. 5

[58] Field of Search ..... 272/76–78, 272/DIG. 5, DIG. 9; 273/26 A, 374, 375, 376; 340/323 R; 73/379

[56] References Cited

U.S. PATENT DOCUMENTS

| | | | |
|---|---|---|---|
| 1,042,816 | 10/1912 | Nevels | 272/78 |
| 2,249,309 | 7/1941 | Benko | 272/DIG. 5 |
| 4,088,315 | 5/1978 | Schemmel | 272/76 |
| 4,142,723 | 3/1979 | Rief | 273/376 |

FOREIGN PATENT DOCUMENTS

| | | | |
|---|---|---|---|
| 47908 | 8/1979 | Japan | 272/DIG. 9 |
| 7031 | 3/1909 | United Kingdom | 272/78 |
| 141691 | 3/1961 | U.S.S.R. | 43 A/33 |
| 598,613 | 3/1978 | U.S.S.R. | 272/76 |
| 975971 | 9/1982 | U.S.S.R. | 272/76 |

*Primary Examiner*—Vincent Millin
*Assistant Examiner*—S. R. Crow
*Attorney, Agent, or Firm*—Christie, Parker & Hale

[57] ABSTRACT

Apparatus for use with conventional punching, striking or speed bags to indicate the frequency at which the bag impacts the platform from which it is suspended in response to the bag being hit by the user of the bag in training or recreation, includes a switch, mounted on or in the platform from which the bag is suspended, disposed along the impact point loci defined by the bag impacting against said platform, which sends a signal to a frequency counter and display oriented for easy visibility by the person hitting the bag.

5 Claims, 6 Drawing Figures

SPEED AND STRIKING BAG FREQUENCY DEVICE

FIELD OF THE INVENTION

This invention relates generally to athletic and recreational equipment and specifically to speed bags, striking bags or similar small punching bags (herein called generically "speed bags"). These speed bags are used to develop coordination and quickness, not power.

BACKGROUND OF THE INVENTION

A principal object of the present invention is to provide users of speed bags an instant, objective measure of the frequency at which the speed bag impacts the platform from which it is suspended in response to the bag being hit by the user of the bag. Because the frequency at which the speed bag impacts the platform from which it is suspended is a function of a user's coordination and quickness in hitting the bag, the invention will enable users to monitor improvements or setbacks in their physical coordination and quickness as measured by their ability to hit the bag and thus to effect changes in the frequency at which the bag impacts the platform from which it is suspended.

A further object is to provide an objective and absolute measure by which one user of a speed bag may compare his ability to hit the bag to that of other users and thus to compare his physical quickness and coordination to that of other users.

A further object is to enhance the use of speed bags for enjoyment and recreation by enabling users to 'see' instantly displayed a measure of how frequently they are hitting the bag, and to 'see' instantly displayed the highest number of impacts with which they were able to hit the bag in a given period of time (e.g., impacts per minute or "IPMs").

Further objects are to provide a system as described which is economical, durable, easy-to-use, portable, safe and for use with any standard or conventional speed bag at home, at health clubs or gyms, or wherever speed bags are used.

SUMMARY OF THE INVENTION

In brief summary given as cursive description only and not as limitation, the invention includes a switch mounted in or on the platform from which the speed bag is suspended which sends a signal to a frequency counter and display oriented for easy visibility by the user, and thus measures the frequency at which the speed bag impacts the platform from which it is suspended.

BRIEF DESCRIPTION OF THE DRAWINGS

The above and other objects and advantages of this invention will be become more readily apparent on examination of the following description including the drawings in which.

DETAILED DESCRIPTION

Figure 1:
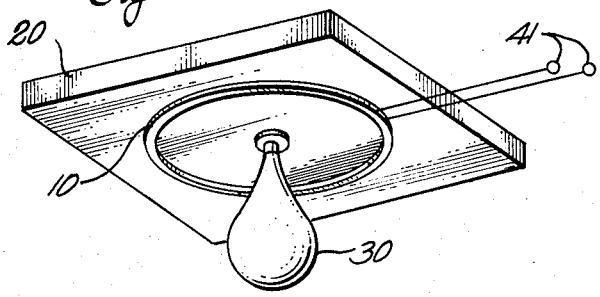
FIG. 1 is a trimetric projection of a first embodiment of the invention in use.
Figure 2:
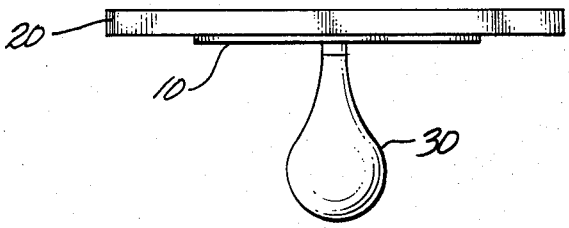
FIG. 2 is a side elevational view of a first embodiment.
Figure 3:
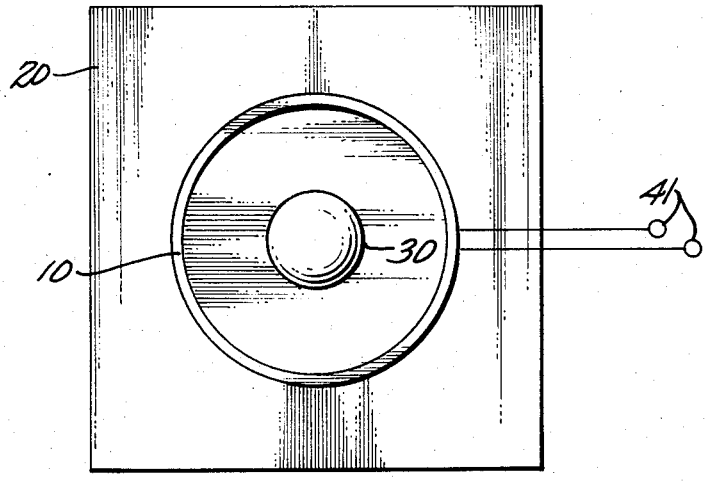
FIG. 3 is a plan view of a first embodiment.

The features of a specific embodiment of the best mode contemplated of carrying out the invention are illustrated in the drawings. FIG. 1 shows the invention embodied in conductive rings 10 bolted to the platform 20 which supports the speed bag 30. The conductive rings form an electrical switch in this embodiment which sends an electrical signal 40 (FIG. 6) to a frequency counter 70 and display 80. Any complete swing of the speed bag results in the conductive rings coming into contact and sending an electrical signal 40 to the frequency counter 70 and display 80. FIGS. 2 and 3 are orthographic projections, a side elevation and a plan view respectively, which show the conductive rings 10 bolted to the platform 20, the electrical leads 41 leaving the assembly and the location of the speed bag 30 relative to the other components in this embodiment.

Figure 4:
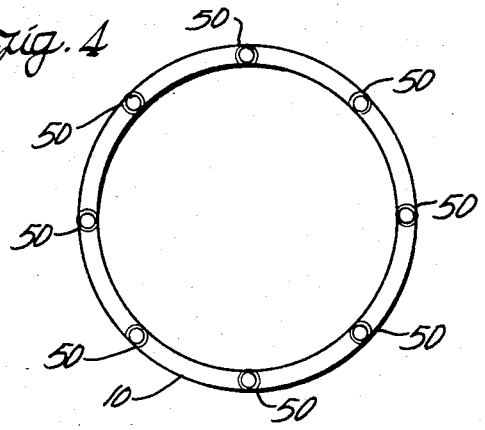
FIG. 4 is a top plan partial detail adapted from FIG. 3 of the two conductive rings.

FIG. 4 shows the location of eight compression springs 50 which maintain separation between the two conductive rings 10 while not in contact.

Figure 5:
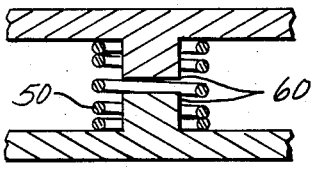
FIG. 5 is a sectional detail of a typical helical compression spring usable with this invention.

FIG. 5 is a detail of a typical compression spring 50 which in this embodiment is a helical spring and shows the relative separation of the two conductive rings 10. Two contact posts 60 are integrally machined as part of the conductive rings 10 in this embodiment.

Figure 6:
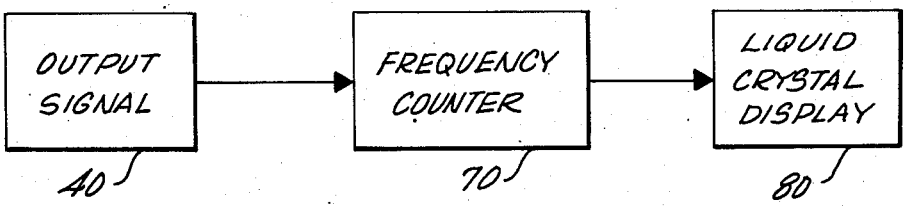
FIG. 6 is a block diagram depicting a method of displaying the frequency of speed bag impacts on a liquid crystal display.

FIG. 6 is a block diagram showing the output signal 40 which is generated by the conductive rings coming into contact, entering a frequency counter which measures the impacts of the speed bag against the platform from which the speed bag is suspended, and then being displayed on a suitable display device (liquid crystal display in this embodiment) 80 oriented for easy visibility by the user of the bag.

It will be apparent from the foregoing that the Speed and Striking Bag Frequency Device provides an objective measure of the frequency at which any conventional speed bag impacts the platform from which it is suspended in response to hits by the user, and provides a simple, lightweight, portable, economical and safe device which can be easily and quickly installed for use with any conventional speed bag in any location where such bags are used.

This invention is not to be construed as limited to the particular forms disclosed herein, since these are to be regarded as illustrative rather than restrictive. Therefore, it is to be understood that the invention may be practical within the scope of the claims otherwise than as specifically described.

What is claimed and desired to be protected by United States Letters Patent is:

1. A device for sensing the frequency at which a bag rotatably suspended from a platform is struck comprising:

means for sensing the impact of the bag propelled by a strike against the platform, said bag rebounding from the platform to be struck again, the sensing means including conductive rings disposed at the platform and adapted to generate a signal when said rings make mutual contact and means for maintaining the rings out of contact, at least one of said rings arranged to be struck by the bag when it impacts the platform, said rings upon impact contacting and generating said signal;

means for determining the frequency of sensed impacts per unit time, the determining means adapted to receive said signal to determine frequency; and means for displaying the determined frequency.

2. The device of claim 1 wherein the maintaining means includes at least one spring.

3. The device of claim 2 wherein the maintaining means includes a plurality of springs.

4. The device of claim 1 wherein said conductive rings are circular.

5. A speed bag assembly and impact sensing means, said assembly comprising:

a rebound platform for the speed bag, the bag rotatably suspended from the platform and adapted to be struck and propelled to engage and rebound from the platform;

means for sensing each engagement of the bag against the platform including a pair of spaced rings arranged on the platform such that at least one of said rings is impacted by the bag when it engages the platform, said engagement causing the rings to make contact, and means for generating a signal when said rings make contact;

means for determining the frequency of sensed engagements including means for processing said signals to determine frequency and means for displaying said determined frequency.

* * * * *